United States Patent [19]

Saen et al.

[11] Patent Number: 4,870,227

[45] Date of Patent: Sep. 26, 1989

[54] SPOT-WELDING NICKEL-PLATED METAL TERMINAL

[75] Inventors: Haruo Saen; Kougi Kobayashi, both of Tochigi, Japan

[73] Assignee: Sumitomo Electric Industries Ltd., Osaka, Japan

[21] Appl. No.: 141,748

[22] Filed: Jan. 11, 1988

[30] Foreign Application Priority Data

Jan. 9, 1987 [JP] Japan ..... 62-2862

[51] Int. Cl.[4] ..... H01B 11/02

[52] U.S. Cl. ..... 174/117 F F; 439/886; 439/887; 219/91.2

[58] Field of Search ..... 29/879, 885, 860; 439/886, 874, 875, 887; 219/91.2, 86.1; 174/117 T T

[56] References Cited

U.S. PATENT DOCUMENTS 3,927,841 12/1975 Iacobucci ..... 439/886
4,130,750 12/1978 Bennett ..... 219/86.1

OTHER PUBLICATIONS

Hawley, The Condensed Chemical Dictionary, 1977, p. 679.

*Primary Examiner*—E. A. Goldberg
*Assistant Examiner*—Scott A. Rogers
*Attorney, Agent, or Firm*—Sughrue, Mion, Zinn, Macpeak & Seas

[57] ABSTRACT

A nickel-plated metal terminal to be spot welded has a contact part plated with nickel and a spot welding part to be spot welded to a metal part not plated with nickel thereby improving the weld characteristic of the spot welded terminal.

8 Claims, 1 Drawing Sheet

SPOT-WELDING NICKEL-PLATED METAL TERMINAL

BACKGROUND OF THE INVENTION

This invention relates to the structure of a nickel-plated metal terminal of an electrical connector which is spot-welded to an electrical conductor.

In general, the metal terminals of an electrical connector are plated with gold, silver, tin or nickel to prevent an increase in contact resistance caused, for instance, by corrosion. However, the relationship between the plating material and the spot welding operation have not been sufficiently understood.

It has, however, been found that, among the plating materials, nickel greatly affects spot welding conditions. More specifically it has been determined that spot welding conditions change with changes in the thickness of the nickel plating. This may give rise to defective welds represented by insufficient weld depth and cracking.

SUMMARY OF THE INVENTION

Accordingly, an object of this invention is to eliminate the above-described difficulties accompanying a conventional spot-welding of a nickel-plated metal terminal.

The foregoing object and other objects of the invention as will be apparent from the following description of the invention, have been achieved by the provision of a metal terminal to be spot welded which is first plated with nickel and then plated with gold, tin or silver, and which has the part thereof to be spot welded to a metal part not plated with nickel.

The nature, principle and utility of the invention will become more apparent from the following detailed description when read in conjunction with the accompanying drawings.

DETAILED DESCRIPTION OF THE INVENTION

Figure 1:
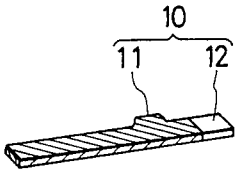
FIG. 1 is a perspective view showing a first example of a spot welding nickel-plated metal terminal according to this invention.
Figure 2:
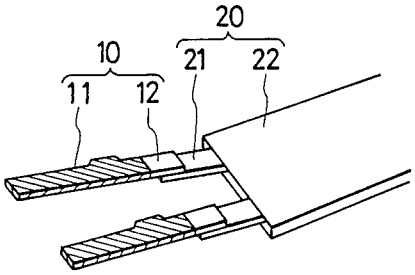
FIG. 2 is a perspective view showing the metal terminals spot-welded to the conductors of a flat cable.

A first example of a spot welding nickel-plated metal terminal according to this invention is as shown in FIG. 1. The flat metal terminal 10 comprises a part 11 plated with nickel and a part 12 not plated with nickel. As shown in FIG. 2, the metal terminal 10 is connected, for example, to a flat-type conductor 21 of a flat cable 20 by spot welding. The conductor 21 is covered by an insulator 22.

The reason why nickel plating effects spot welding conditions is not precisely known yet. However, it is believed to be based on the Peltier effect.

The following Table 1 indicates spot welding currents where phosphor bronze terminals which are first plated with nickel and then plated with gold are spot-welded to a tin-plated flat-type copper wire:

TABLE 1

| | | | | |
|---|---|---|---|---|
| Gold plating Thickness | 1.05 μm | | | |
| Nickel plating Thickness | None | 0.8 μm | 1.5 μm | 2 μm |
| Suitable spot welding current | 1.25 kA | 1.30 kA | 1.40 kA | 1.53 kA |

As is apparent from Table 1, above, the suitable spot welding current depends on the nickel plating thickness. According to the ordinary manufacturing specifications for electrical connectors for electrical appliances, the tolerance of the nickel plating thickness is generally more than ±0.5 μm. This means that different spot welding currents must be provided for different electrical terminals. As this is not practical, the manufactured electrical terminals fluctuate in spot welding strength and external appearance.

Accordingly, the nickel plating which adversely affects an electrical terminal as described above is, according to the teachings of this invention not applied to at least the part of the terminal to be spot welded so that the spot welding operating can be achieved with high reliability. The electrical terminal's contact part, which is essential for the connector, can be plated with nickel in the usual manner. Therefore, the connector with the electrical terminals thus plated with nickel has the same electrical reliability as prior connectors.

For a full understanding of the invention, the following concrete examples of the spot welding nickel-plated metal terminal of the invention will be described.

EXAMPLE 1

As shown in FIG. 1, a phophor bronze terminal 10 having a thickness of 0.5 mm comprises: a spot welding part 12, which is not plated with nickel, of about 5 mm in length from the end; and a remaining part plated with nickel to a thickness of 1 μm. The metal terminal thus formed is spot-welded to a tin-plated flat-type copper conductor 21 of a flat cable 20, as shown in FIG. 2. In FIG. 2, a reference numeral 22 designates an insulator.

EXAMPLE 2

Figure 3:
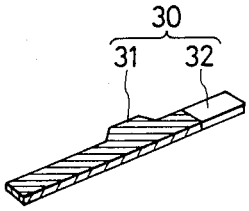
FIGS. 3 and 4 are a perspective view and a sectional view, respectively, showing a second example of the metal terminal according to the invention.
Figure 4:
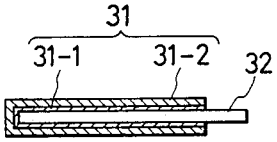

As shown in FIG. 3 and FIG. 4, a phosphor bronze terminal 30 having a thickness of 0.5 mm comprises: a spot welding part 32, which is not plated with nickel, of about 5 mm in length from the end; and a remaining part 31 which is plated with nickel to a thickness of 1 μm as indicated at 31–1, and then plated with gold, tin or silver as indicated at 31–2. The electrical terminal thus formed is spot welded to a conductor of a flat cable as shown in FIG. 2.

EXAMPLE 3

Figure 5:
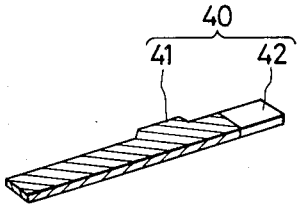
FIGS. 5 and 6 are a perspective view and a sectional view, respectively, showing a third example of the metal terminal according to the invention.
Figure 6:
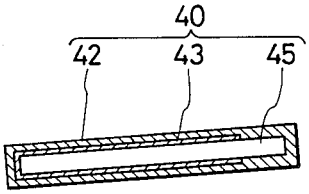

As shown in FIGS. 5 and 6, a phosphor bronze terminal 40 having a thickness of 0.5 mm comprises: a spot welding part 42, which is not plated with nickel, of about 5 mm in length from the end; and a remaining part 41. The remaining part 41 is plated with nickel to a thickness of 1 μm as indicated at 43, and then the terminal is plated, in its entirety, with gold, tin or silver as indicated at 42. The metal terminal thus manufactured is spot-welded to a conductor of a flat cable as shown in FIG. 2. In FIGS. 5 and 6, reference numeral 43 designates a nickel base plating; 42, a single-layer finish plating part; 41, a double-layer plating part; and 45, the terminal's base metal.

As was described above, the spot welding part of the metal terminal according to the invention is not plated with nickel. This will stabilize the spot welding conditions. That is, the spot welding strength is made substantially uniform, and the spot welding part is prevented from being cracked. In other words, the metal terminal can be spot-welded with high quality. On the other hand, the contact part of the terminal can be plated in the usual manner. Therefore, the metal terminal of the invention is high in electrical contact characteristics. Thus, employment of the metal terminals of the invention for connecting cables and connectors in the signal transmission path of a computer will minimize connector failures.

What is claimed is:

1. A flat metal terminal which is connected to a flat-type conductor of a flat cable by a spot weld, said terminal comprising:

a contact part having a nickel plating; and a spot welding part having no nickel plating, wherein the spot welding part of said flat metal terminal which has no nickel plating is connected to said flat-type conductor by said spot weld such that the strength of said spot weld is substantially uniform.

2. The flat metal terminal as claimed in claim 1, wherein said contact part has gold, tin or silver plating over said nickel plating, and said spot welding part has no plating.

3. The flat metal terminal as claimed in claim 1, wherein said contact part has gold, tin or silver plating over said nickel plating and said spot welding part is also plated with gold, tin or silver.

4. In a method of forming a flat metal terminal which is connected to a flat-type conductor of a flat cable by a spot weld, said method comprising the steps of:

designating a contact part and a spot welding part of said flat metal terminal;

plating the contact part with nickel;

not plating the spot welding part with nickel; and spot welding said spot welding part of said flat metal terminal to said flat-type conductor such that the strength of said spot weld is substantially uniform.

5. The method as claimed in claim 4, further including the step of further plating the contact part with gold, tin or silver over the nickel plating.

6. The method as claimed in claim 4, further including the step of plating both the contact part and the spot welding part with gold, tin or silver, said gold, tin or silver plating of said contact part taking place over said nickel plating.

7. The flat metal terminal as claimed in claim 1, wherein said terminal is formed of phosphor bronze.

8. The method as claimed in claim 4, wherein said terminal is formed of phosphor bronze.

* * * * *